US005249939A

United States Patent [19]

Takahashi

[11] Patent Number: 5,249,939

[45] Date of Patent: Oct. 5, 1993

[54] VALVED DISCHARGE MECHANISM OF A REFRIGERANT COMPRESSOR

[75] Inventor: Hareo Takahashi, Takasaki, Japan

[73] Assignee: Sanden Corporation, Gunma, Japan

[21] Appl. No.: 864,419

[22] Filed: Apr. 6, 1992

Related U.S. Application Data

[63] Continuation of Ser. No. 639,189, Jan. 9, 1991, Pat. No. 5,118,266.

[30] Foreign Application Priority Data

Jan. 9, 1990 [JP] Japan ..... 2-955

[51] Int. Cl.[5] ..... F04B 21/02

[52] U.S. Cl. ..... 417/569; 417/566

[58] Field of Search ..... 417/566, 569, 570, 571

[56] References Cited

U.S. PATENT DOCUMENTS

| | | | |
|---|---|---|---|
| 1,555,192 | 9/1925 | Dennedy . | |
| 1,748,531 | 2/1930 | Troup . | |
| 1,892,711 | 1/1933 | Summers . | |
| 1,915,694 | 6/1933 | Reindel . | |
| 2,019,747 | 11/1935 | Taylor . | |
| 2,154,880 | 4/1939 | Twigg . | |
| 2,434,734 | 1/1948 | Buschmann . | |
| 2,592,343 | 4/1952 | Scheldorf . | |
| 2,647,683 | 8/1953 | Schweller . | |
| 2,792,790 | 5/1957 | Capps . | |
| 3,509,907 | 5/1970 | Gannaway . | |
| 3,761,202 | 9/1973 | Mitchell | 417/269 |
| 3,838,942 | 10/1974 | Pokorny | 417/269 |
| 3,861,829 | 1/1975 | Roberts et al. | 417/53 |
| 4,011,029 | 3/1977 | Shimizu | 417/269 |
| 4,039,270 | 8/1977 | Hiraga | 417/569 |
| 4,642,037 | 2/1987 | Fritchman | 417/559 |

FOREIGN PATENT DOCUMENTS

| | | |
|---|---|---|
| 556690 | 4/1923 | France . |
| 737908 | 10/1955 | United Kingdom . |
| 754454 | 8/1956 | United Kingdom . |
| 839169 | 6/1960 | United Kingdom . |
| A2156046 | 10/1985 | United Kingdom . |
| A2163236 | 2/1986 | United Kingdom . |

*Primary Examiner*—Richard A. Bertsch
*Assistant Examiner*—Charles G. Freay
*Attorney, Agent, or Firm*—Baker & Botts

[57] ABSTRACT

The present invention is directed to an improved valved discharge mechanism of a refrigerant compressor. The compressor includes a compressor housing having at least one chamber in which successive strokes of sucking, compressing, and discharging a refrigerant gas is repeatedly performed. The chamber is linked to an outside chamber through a conduit formed in the compressor housing. A valved discharge mechanism is disposed at one end opening of the conduit which opens to the outside chamber. The valved discharge mechanism includes a discharge reed valve which by means of a bending movement blocks and opens the one end opening of the conduit. The discharge reed valve has a predetermined value of elastic modulus which allows the discharge reed valve to keep blocking the one end opening of the conduit until the pressure in the chamber reaches a predetermined value. A stopper member is disposed in the outside chamber to limit the bending movement of the discharge reed valve toward the direction in which the refrigerant gas leaves from the one end opening of the conduit. An auxiliary discharge reed valve having a small curvature is proximately disposed on the discharge reed valve opposite to the one end opening of the conduit so as to enhance the value of the elastic modulus of the discharge reed valve while the discharge reed valve is bent in the direction in which the refrigerant gas leaves from the one end opening of the conduit.

8 Claims, 8 Drawing Sheets

VALVED DISCHARGE MECHANISM OF A REFRIGERANT COMPRESSOR

This application is a continuation of application Ser. No. 07/639,189, filed Jan. 9, 1991, now U.S. Pat. No. 5,118,266.

BACKGROUND OF THE INVENTION

1. Field of the Invention

The present invention generally relates to a refrigerant compressor, and more particularly, to a valved discharge mechanism of a refrigerant compressor used in an automotive air conditioning system.

2. Description of the Prior Art

A piston-type refrigerant compressor, such as a wobble plate type refrigerant compressor, suitable for use in an automobile air conditioning system is disclosed in U.S. Pat. No. 4,722,671 to Azami et al.

Referring to FIG. 1, the wobble plate type refrigerant compressor 10 is comprised of cylindrical housing 11. Cylindrical housing 11 includes cylinder block 111, front end plate 112, and cylinder head 113. The interior of housing 11 defines crank chamber 114 between cylinder block 111 and front end plate 112. Front end plate 112 is mounted on the left end portion of cylinder block 111 by a plurality of bolts 12. Cylinder head 113 and valve plate assembly 13 are mounted on the right end portion of cylinder block 111 by a plurality of bolts 14. Opening 112*a* is centrally formed in front end plate 112 and drive shaft 15 is rotatably supported by a bearing, such as radial needle bearing 16 disposed in opening 112*a*. Front end plate 112 includes annular sleeve portion 112*b* projecting from the front surface thereof. Annular sleeve portion 112*b* surrounds drive shaft 15 to define a shaft seal cavity in which a shaft seal element (not shown) is disposed.

The inner end of drive shaft 15 is attached to cam rotor 17 by any suitable means so that cam rotor 17 is rotated along with drive shaft 15. Cam rotor 17 is supported on an inner surface of front end plate 112 by means of a bearing, such as thrust needle bearing 18 disposed on the inner surface of front end plate 112. Wobble plate 19 is disposed on inclined surface 17*a* of cam rotor 17 through thrust needle bearing 20.

Supporting member 21, including shank portion 211 having axial hole 211*a* formed therein, is axially slidable but non-rotatably supported within cylinder block 111 by the insertion of shank portion 211 into axial hole 111*a* formed in cylinder block 111. The rotation of supporting member 21 is prevented by means of a key and key groove (not shown). Supporting member 21 further includes bevel gear portion 212 at the end of shank portion 211. Bevel gear portion 212 includes a seat for steel ball 22 at the center thereof. Bevel gear portion 212 of supporting member 21 engages with bevel gear 23 mounted on wobble plate 19. Steel ball 22 is also seated in a seat formed at the central portion of bevel gear 23 so that wobble plate 19 may be nutably but non-rotatably supported on steel ball 22. Coil spring 24 is disposed in axial hole 211*a* of supporting member 21. The outer end of coil spring 24 is in contact with screw member 25 so that supporting member 21 is urged toward wobble plate 19.

Cylinder block 111 is provided with a plurality of axial cylinders 26 formed therein. Pistons 27 are slidably and closely fitted in axial cylinders 26. Each piston 27 is connected to wobble plate 19 through piston rod 28.

The ends of piston rods 28 are connected to wobble plate 19 by a plurality of ball joint mechanisms. Similarly, each piston 27 is also connected to the other end of each piston rod 28 by a plurality of ball joint mechanisms.

Cylinder head 113 is provided with suction chamber 29 and discharge chamber 30 separated by partition wall 113*a*. Valve plate assembly 13 includes valve plate 131 having suction ports 29*a* connecting suction chamber 29 with cylinders 26 and discharge ports 30*a* connecting discharge chamber 30 with cylinders 26.

Referring to FIG. 2, valve plate assembly 13 further includes suction reed valve 132, discharge reed valve 133, circular gasket 134, and annular gasket 135. Suction reed valve 132 and discharge reed valve 133 are made of an elastic material. Circular gasket 134 includes a plurality of circular cut-out portions located so that they correspond to the respective cylinders 26. A peripheral portion of circular gasket 134 is sandwiched by the peripheral portion of cylinder block 111 and the inner surface of a peripheral portion of valve plate 131. A central portion of circular gasket 134 is sandwiched by the central portion of cylinder block 111 and the inner surface of a central portion of valve plate 131. Suction reed valve 132 is sandwiched between a central portion of circular gasket 134 and the inner surface of a central portion of valve plate 131. Annular gasket 135 includes a plurality of cut-out portions located so that they correspond to suction chamber 29. Annular gasket 135 is sandwiched by the peripheral portion of cylinder head 113 and the outer surface of a peripheral portion of valve plate 131. Gaskets 134 and 135 seal the mating surfaces of cylinder block 111, valve plate 131, and cylinder head 113. Stopper plate 31 suppresses excessive deformation of discharge reed valve 133. Bolt and nut device 32 secures gasket 134, suction reed valve 132, discharge reed valve 133, and stopper plate 31 to valve plate 131. Discharge reed valve 133, stopper plate 31, and bolt and nut device 32 constitute valved discharge mechanism 400.

In the operation of the compressor, drive shaft 15 is driven by any suitable driving source, such as an automobile engine. Cam rotor 17 rotates with drive shaft 15, so that wobble plate 19 may nutate about steel ball 22 according to the rotation of inclined surface 17*a* of cam rotor 17. The nutation of wobble plate 19 causes the reciprocation of each respective piston 27. Therefore, the successive strokes of sucking, compressing, and discharging the refrigerant gas is repeatedly performed in each cylinder 26. The refrigerant gas circulates through a cooling circuit which is connected between inlet port 33 and outlet port 34. Inlet port 33 is connected with suction chamber 29 and outlet port 34 is connected with discharge chamber 30.

In consideration of durability and efficiency of the compressor, the elastic modulus of discharge reed valve 133 is designed to have a predetermined value which allows discharge reed valve 133 to keep blocking discharge port 30*a* until the pressure in cylinder 26 reaches a predetermined value in the stroke of compressing the refrigerant gas. Hence, when the pressure in cylinder 26 exceeds the predetermined value in the stroke of compressing the refrigerant gas, discharge reed valve 133 begins to bend to the right. Thus, the compressed refrigerant gas in cylinder 26 begins discharging into discharge chamber 30 thru discharge port 30*a*. That is, the stroke of discharging the refrigerant gas begins. However, when the rate of flow of the refrigerant gas from cylinder 26 into discharge chamber 30 is remarkably increased due to the operation of the compressor at a high rotational speed or when a liquid is compressed in cylinder 26 due to the abnormal operation of the cooling circuit, discharge reed valve 133 is excessively bent to the right. Thus, discharge reed valve 133 may be damaged.

To resolve the above-mentioned defect, one prior art compressor is provided with stopper plate 31, as illustrated in FIGS. 1 and 2. Stopper plate 31 is made of a material with a high rigidity and is permanently bent to the right. The fulcrum point where the bend begins is located approximately three-quarters of the way along the length of stopper plate 31 from bolt and nut device 32. The excessive bending of discharge reed valve 133 to the right is effectively prevented by discharge reed valve 133 contacting with a curved inner surface of stopper plate 31.

However, stopper plate 31 is designed to be widely bent so as to avoid reducing the pressure loss at discharge port 30*a*, and thus, preventing a decrease of the compressor efficiency. Therefore, when the rate of flow of the refrigerant gas from cylinder 26 to discharge chamber 30 is small due to the operation of the compressor at low or medium rotational speeds, discharge reed valve 133 does not come into contact with the inner surface of stopper plate 31. Hence, discharge reed valve 133 noticeably vibrates. The vibration occurs because the predetermined value of the elastic modulus of discharge reed valve 133 is not the value of elastic modules which can effectively suppress the vibration of discharge reed valve 133 due to the discharging of the refrigerant gas. This noticeable vibration of discharge reed valve 133 propagates to the passenger compartment of the vehicle as an offensive noise.

FIG. 3 illustrates an enlarged partial sectional view of a valved discharge mechanism of a rotary-type hermetic compressor, such as a vane-type hermetic compressor disclosed in Japanese Patent Application Publication No. 60-8577. Referring to FIG. 3, the vane-type hermetic compressor includes annular block 200 rotatably supporting drive shaft 300. Annular supporting block 200 includes flange 201 radially projecting from an outer peripheral surface thereof, depression 202 formed at a top end surface of flange 201, and axial hole 203 formed in flange 201 as a discharge port. An upper end of axial hole 203 is open to a right side portion of a bottom surface of depression 202. A lower end of axial hole 203 is open to a refrigerant gas working chamber (not shown) defined within a cylinder block (not shown) of the compressor. Supporting block 200 further includes shallow indent 202*a* formed at a central portion of the bottom surface of depression 202.

Discharge reed valve 204 is made of an elastic material and is disposed at the bottom surface of depression 202. Discharge reed valve 204 covers the upper end opening of axial hole 203 with its right end. Auxiliary stopper plate 205 is made of an elastic material and stopper plate 206 is made of a material with a high rigidity. Both auxiliary stopper plate 205 and stopper plate 206 are disposed in depression 202. Stopper plate 206 is placed on top of auxiliary stopper plate 205 which is placed on top of discharge reed valve 204. A left end portion of auxiliary stopper plate 205, a left end portion of stopper plate 206, and a left end portion of discharge reed valve 204 are all secured together to supporting block 200 by means of bolt 207.

Stopper plate 206 is permanently bent upwards. The fulcrum point where the bend begins is located approximately one-half of the way along the length of stopper plate 206 from bolt 207. Stopper plate 206 is designed to be widely bent so as to avoid reducing the pressure loss at the discharge port. Auxiliary stopper plate 205 is also permanently bent upwards. A curvature of an upper surface of auxiliary stopper plate 205 is designed to be greater than a curvature of a lower surface of stopper plate 206, and an upper surface right end of auxiliary stopper plate 205 is in contact with a lower surface right end of stopper plate 206. Thus, thin crescent-shaped air gap 208 is created between the fulcrum point of stopper plate 206 and the upper surface right end of auxiliary stopper plate 205 which is in contact with stopper plate 206. Discharge reed valve 204, auxiliary stopper plate 205, stopper plate 206, and bolt 207 together constitute valved discharge mechanism 401.

In the above-mentioned construction, auxiliary stopper plate 205 can adequately prevent a noise caused by the discharge reed valve 204 colliding with stopper plate 206, and still allow discharge reed valve 204 to quickly close the discharge port. However, the defect which occurs in U.S. Pat. No. 4,722,671 cannot be resolved by this construction. That is, when the compressor operates at low or medium rotational speeds and refrigerant gas is being discharged, discharge reed valve 204 does not come into adequate contact with the lower surface of auxiliary stopper plate 205. Thus, discharge reed valve 204 noticeably vibrates because the predetermined value of the elastic modulus of discharge reed valve 204 is not the value of elastic modules which can effectively suppress the vibration of discharge reed valve 204 due to the discharging of the refrigerant gas. This noticeable vibration of discharge reed valve 204 propagates to the passenger compartment of the vehicle as an offensive noise.

SUMMARY OF THE INVENTION

Accordingly, it is an objective of the present invention to provide a refrigerant compressor for use in an automotive air conditioning system having a valved discharge mechanism which can effectively reduce the vibration of a discharge reed valve, and thus, reduce the propagation of an offensive noise to a passenger compartment of a vehicle.

It is a further objective of the present invention to reduce the vibration of the discharge reed valve, and thus, the propagation of the offensive noise without decreasing the durability or the efficiency of the compressor.

A refrigerant compressor according to the present invention includes a compressor housing defining at least one chamber in which successive strokes of sucking, compressing, and discharging a refrigerant gas is repeatedly performed. The chamber is linked to an outside chamber through a conduit formed in the compressor housing.

Regulating means, such as a valved discharge mechanism, are disposed at one end opening of the conduit which opens to the outside chamber. Regulating means include a plate member, such as a discharge reed valve, which bends to block and open the one end opening of the conduit. The discharge reed valve has a predetermined value of elastic modulus which allows the discharge reed valve to keep blocking the one end opening of the conduit until the pressure in the cylinder chamber reaches a predetermined value. A stopper member is disposed in the outside chamber to limit the bending movement of the discharge reed valve toward the direction in which the refrigerant gas leaves from the one end opening of the conduit.

A mechanism for increasing the value of the elastic modulus of the plate member, such as an auxiliary discharge reed valve having a small curvature, are proximately disposed on the plate member opposite to the one end opening of the conduit. An auxiliary discharge reed valve enhances the value of the elastic modulus of the discharge reed valve while the discharge reed valve is bent in the direction in which the refrigerant gas leaves from the one end opening of the conduit.

DETAILED DESCRIPTION OF THE PREFERRED EMBODIMENTS

Figure 1:
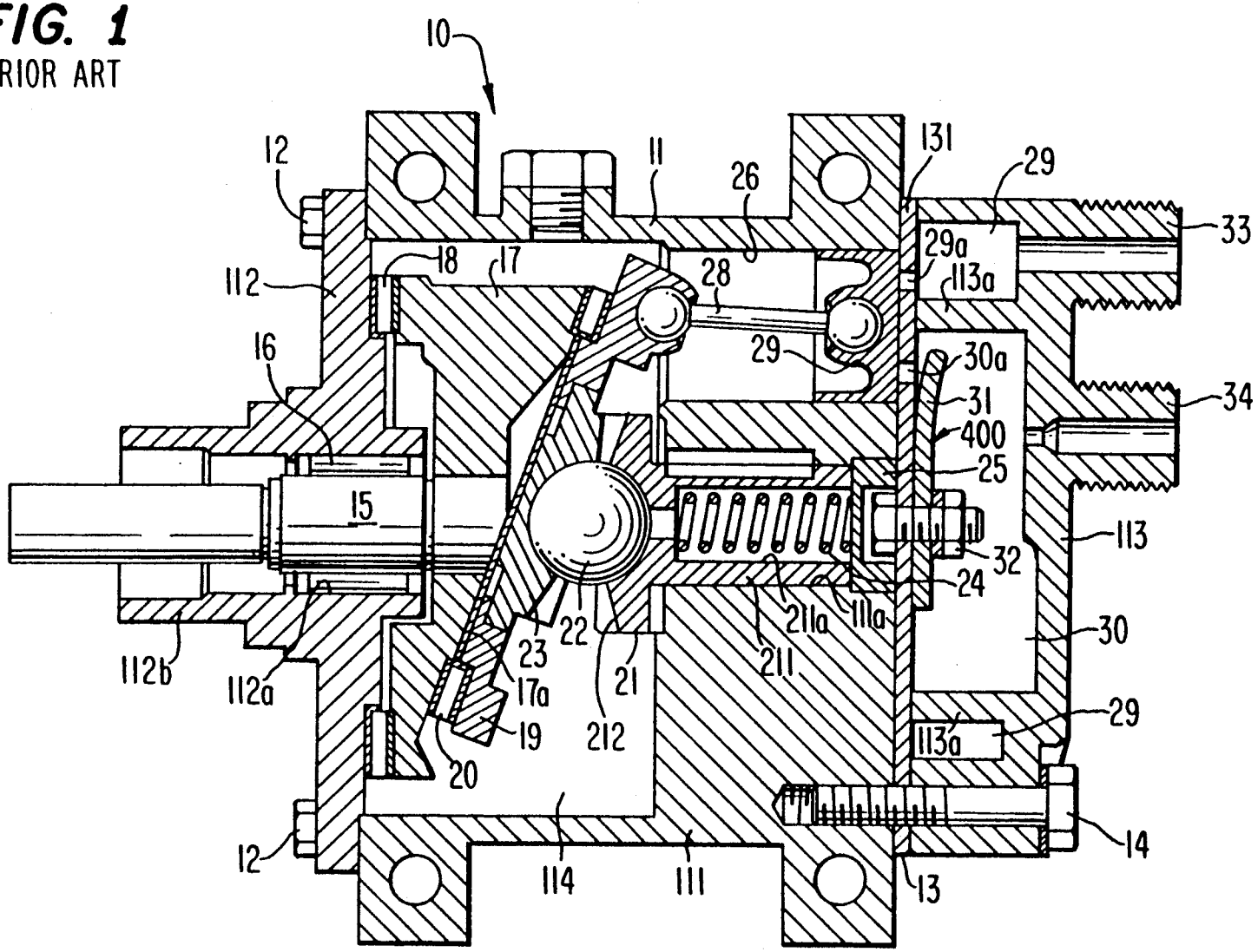
FIG. 1 PRIOR ART
FIG. 1 illustrates a vertical longitudinal sectional view of a wobble plate type refrigerant compressor in accordance with one prior art embodiment of the present invention.
Figure 2:
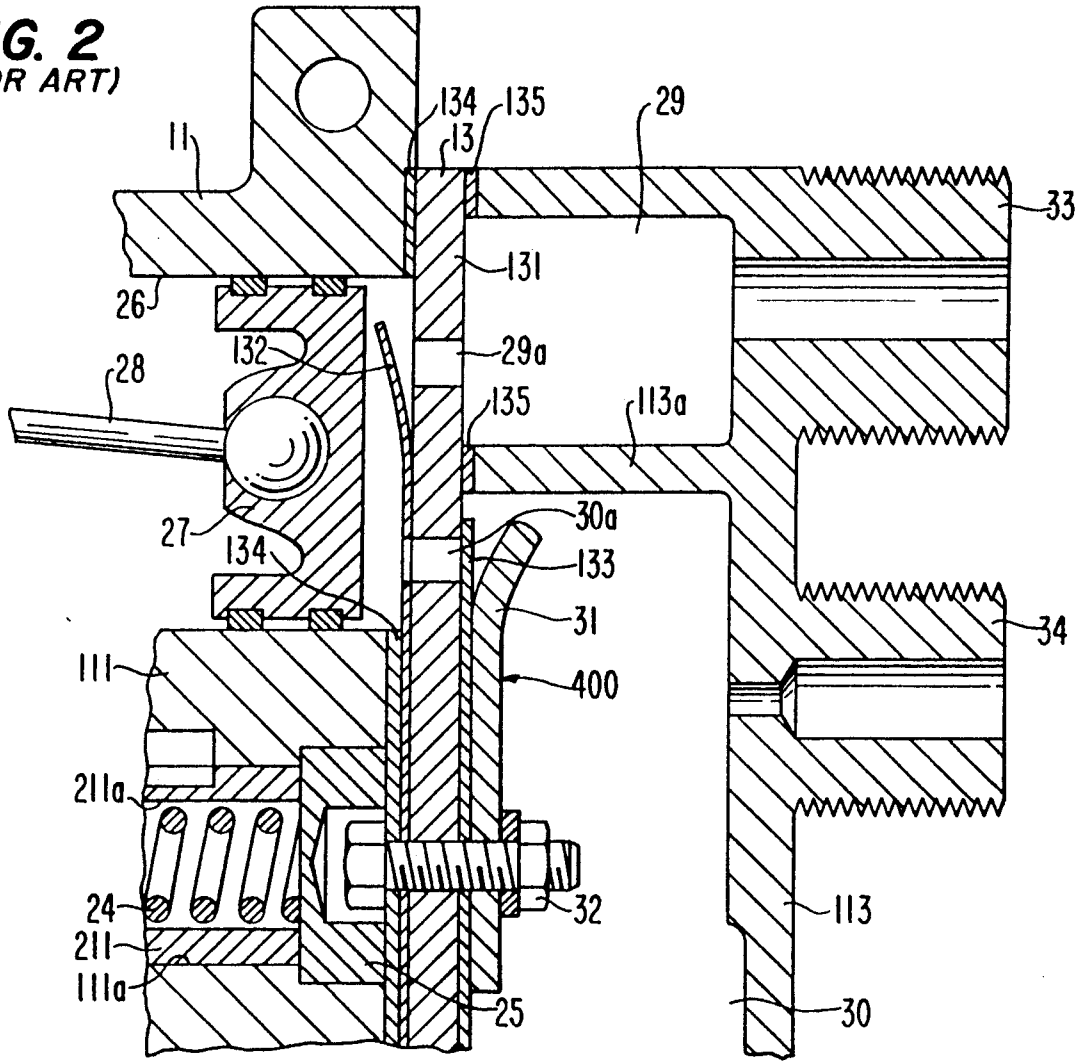
FIG. 2 (PRIOR ART)
FIG. 2 illustrates an enlarged partial sectional view of a valved discharge mechanism shown in FIG. 1. In the drawing, the operation of the valved discharge mechanism during the stroke of sucking the refrigerant gas is illustrated.
Figure 3:
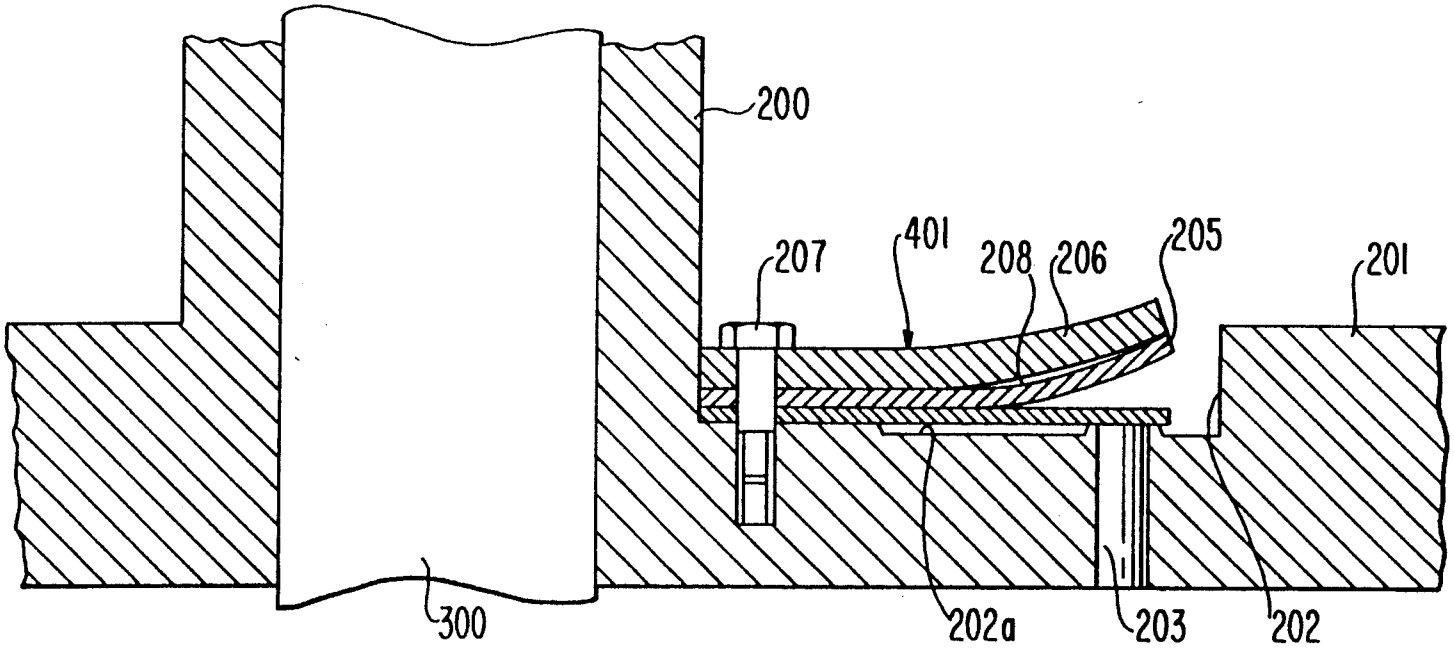
FIG. 3 (PRIOR ART)
FIG. 3 illustrates an enlarged partial sectional view of a valved discharge mechanism of a vane-type refrigerant compressor in accordance with another prior art embodiment of the present invention.

FIGS. 4–7 illustrate an enlarged partial sectional view of a valved discharge mechanism of a wobble plate type refrigerant compressor in accordance with a first embodiment of the present invention. In the drawings, the same numerals are used to denote the corresponding elements shown in FIGS. 1 and 2 so that an explanation thereof is omitted.

Figure 4:
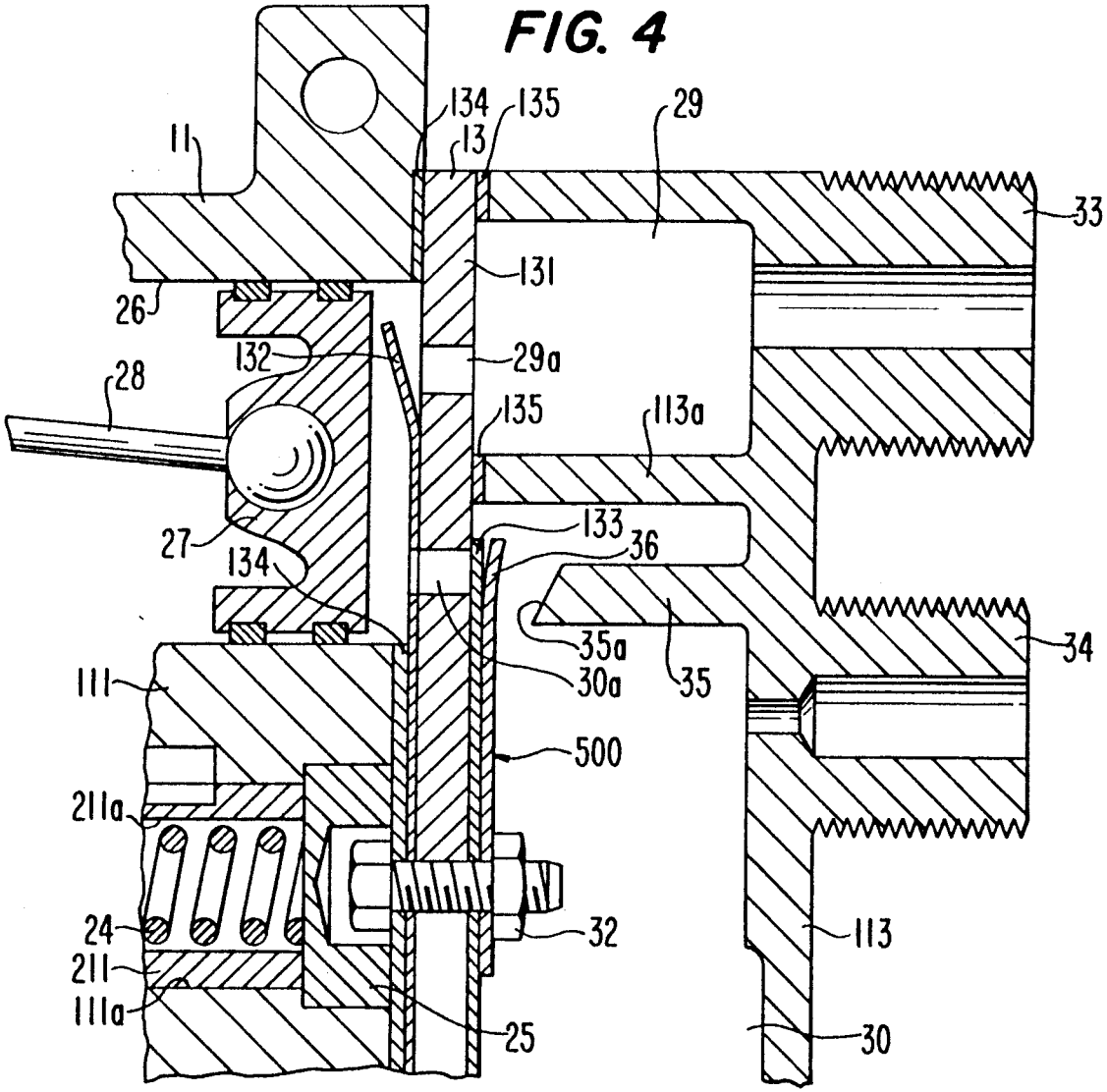
FIG. 4 illustrates an enlarged partial sectional view of a valved discharge mechanism of a wobble plate type refrigerant compressor in accordance with a first embodiment of the present invention. In the drawing, the operation of the valved discharge mechanism during the stroke of sucking the refrigerant gas is illustrated.

FIG. 4 particularly illustrates the operation of the valved discharge mechanism during the stroke of sucking the refrigerant gas. Referring to FIG. 4, the wobble plate type refrigerant compressor includes valved discharge mechanism 500 having discharge reed valve 133, auxiliary discharge reed valve 36 disposed upon discharge reed valve 133, stopper member 35 axially projecting from an inner surface of cylinder head 113, and bolt and nut device 32. Discharge reed valve 133 is in contact with valve plate 131 so as to block discharge port 30*a*. Discharge reed valve 133 and auxiliary discharge reed valve 36 are both made of an elastic material. The value of the elastic modulus of discharge reed valve 133 is designed to allow discharge reed valve 133 to block discharge port 30*a* until the pressure in cylinder 26 reaches a predetermined value during the stroke of compressing the refrigerant gas. Auxiliary discharge reed valve 36 is slightly and permanently bent to the right. A lower end portion of auxiliary discharge reed valve 36 is secured to valve plate 131 by bolt and nut device 32 together with discharge reed valve 133. Stopper member 35 includes end surface 35*a* slanting toward its upper side with a predetermined slant angle.

Figure 5:
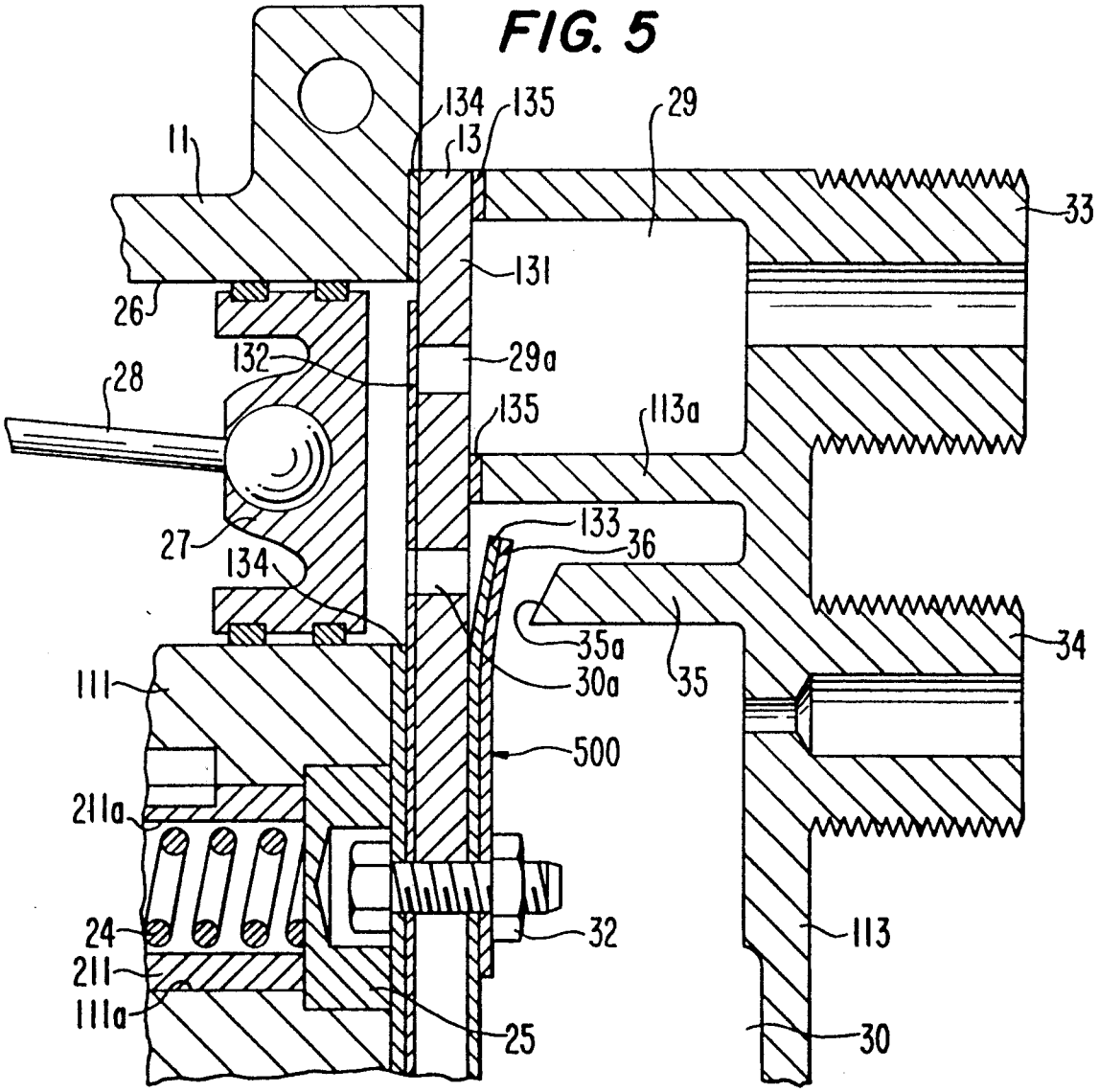
FIG. 5 illustrates a similar view to FIG. 4. In the drawing, the operation of the valved discharge mechanism during the stroke of discharging the refrigerant gas with the compressor operating at a low rotational speed is illustrated.

Referring to FIG. 5, when valved discharged mechanism 500 is operating during the stroke of discharging the refrigerant gas with the compressor operating at a low rotational speed, an outer surface (to the right in FIG. 5) of a terminal end portion of discharge reed valve 133 immediately comes into contact with a curved inner surface (to the left in FIG. 5) of auxiliary discharge reed valve 36. The contact takes place as soon as discharge reed valve 133 begins to be bent to the right by the pressure of the discharged refrigerant gas. Discharge reed valve 133 is then further bent to the right together with auxiliary discharge reed valve 36. Therefore, discharge reed valve 133 and auxiliary discharge reed valve 36 form substantially one elastic element of which the value of its elastic modulus is the sum of the value of the elastic modulus of discharge reed valve 133 and the value of the elastic modulus of auxiliary discharge reed valve 36.

Figure 6:
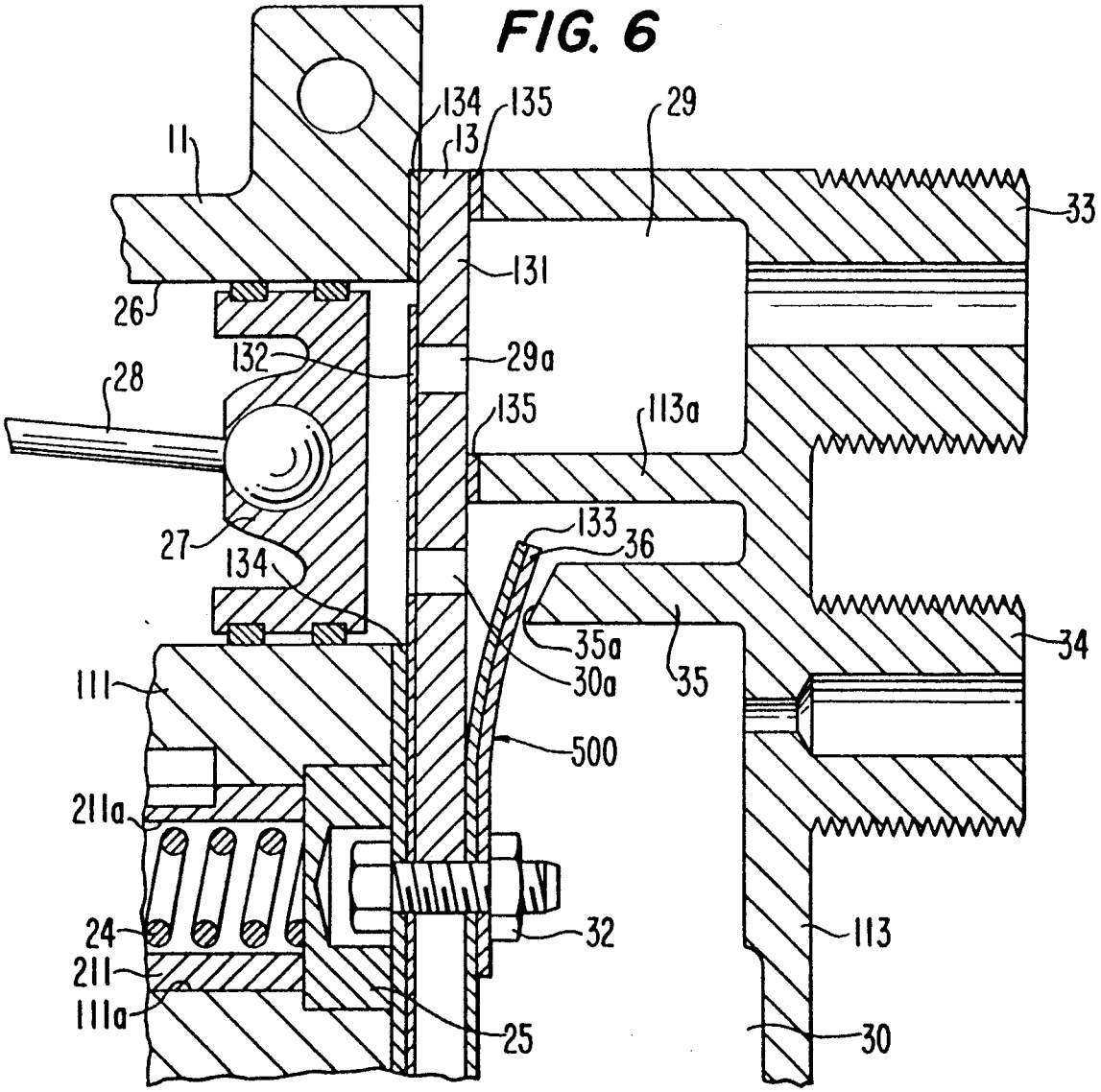
FIG. 6 illustrates a similar view to FIG. 4. In the drawing, the operation of the valved discharge mechanism during the stroke of discharging the refrigerant gas with the compressor operating at a medium rotational speed is illustrated.
Figure 7:
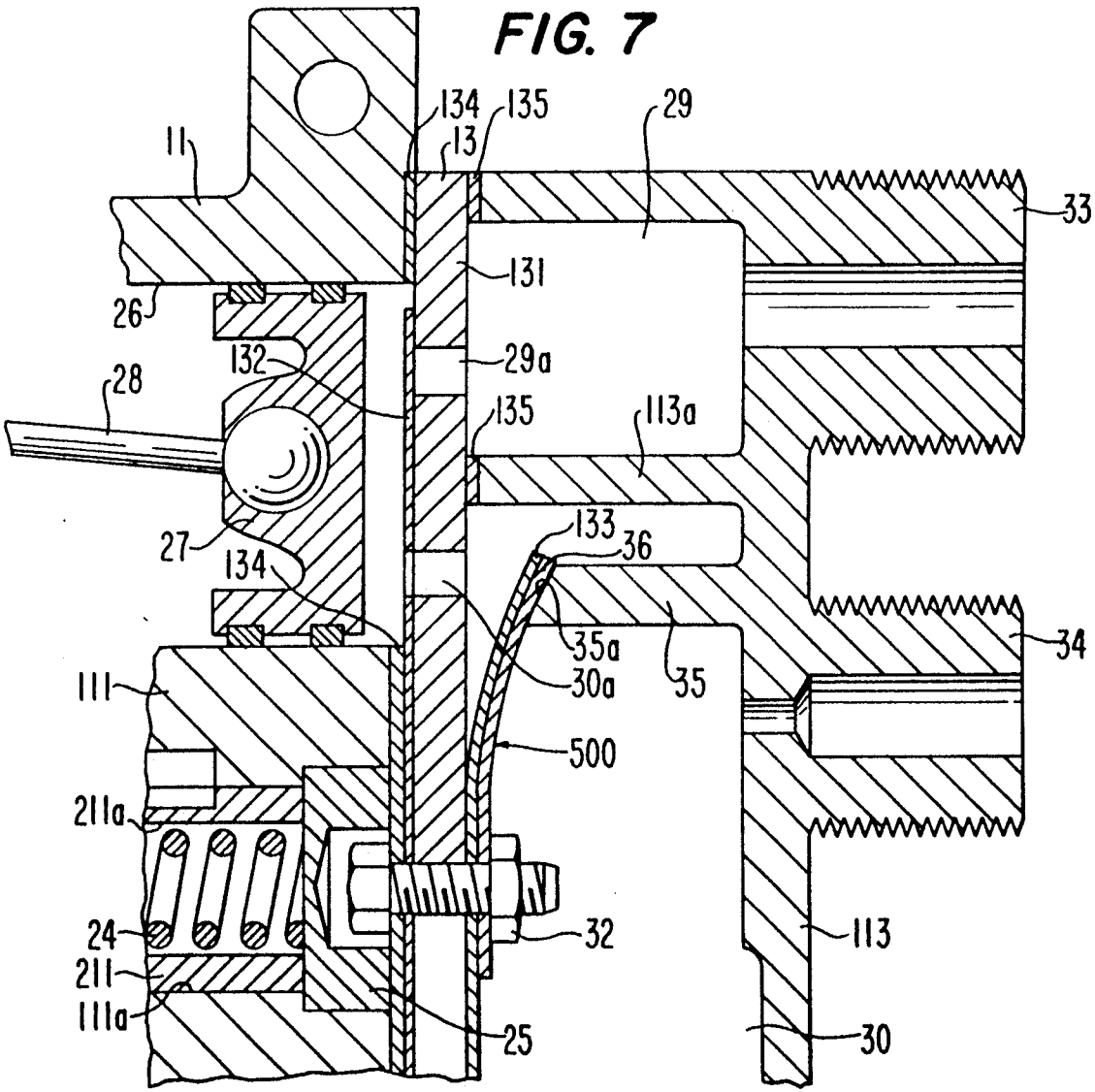
FIG. 7 illustrates a similar view to FIG. 4. In the drawing, the operation of the valved discharge mechanism during the stroke of discharging the refrigerant gas with the compressor operating at a high rotational speed is illustrated.

This manner of forming the substantially one elastic element is maintained continuously during the stroke of discharging the refrigerant gas, even when the compressor is operating at medium or high rotational speeds, as illustrated in FIGS. 6 and 7, respectively. As illustrated in FIG. 7, the excessive bending of the substantially one elastic element can be effectively prevented by the substantially one elastic element coming into contact with slanted end surface 35*a* of stopper member 35. Thus, damage to discharge reed valve 133 and auxiliary discharge reed valve 36 can be effectively prevented.

In consideration of durability and efficiency of the compressor, discharge reed valve 133 of the present invention is designed to have a predetermined value of elastic modules which allows discharge reed valve 133 to keep blocking discharge port 30*a* until the pressure in cylinder 26 reaches a predetermined value during the stroke of compressing the refrigerant gas. However, by designing auxiliary discharge reed valve 36 to have a predetermined value of elastic modulus, the elastic modulus of the substantially one elastic element is able to exceed the value of elastic modulus which can effectively suppress the generation of the noticeable vibration of the substantially one elastic element. Therefore, the vibration of the substantially one elastic element, which would propagate to the passenger compartment of the vehicle as an offensive noise, is effectively reduced. That is, the noticeable vibration of discharge reed valve 133, which propagates to the passenger compartment of the vehicle as the offensive noise, is effectively prevented.

Figure 8:
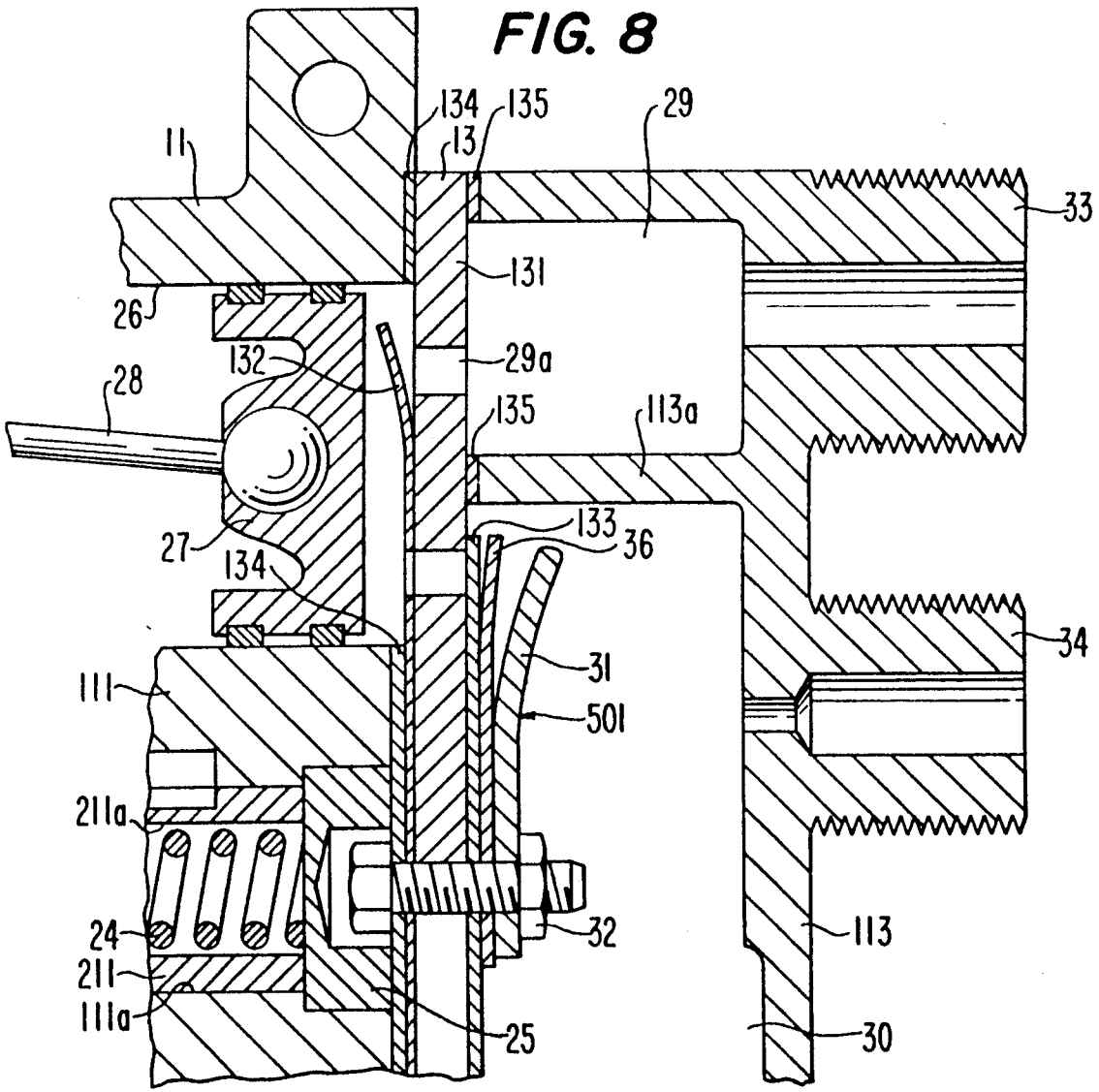
FIG. 8 illustrates an enlarged partial sectional view of a valved discharge mechanism of a wobble plate type refrigerant compressor in accordance with a second embodiment of the present invention. In the drawing, the operation of the valved discharge mechanism during the stroke of sucking the refrigerant gas is illustrated.

FIG. 8 illustrates an enlarged partial sectional view of a valved discharge mechanism of a wobble plate type refrigerant compressor in accordance with a second embodiment of the present invention. In this embodiment, valved discharge mechanism 501 includes stopper plate 31, which is illustrated in prior art FIGS. 1 and 2, being used in place of stopper member 35 of the foregoing first embodiment of the present invention. The effect of the second embodiment is substantially similar to the effect of the first embodiment so that an explanation thereof is omitted.

This invention has been described in detail in connection with the preferred embodiments. But, the description is for illustrative purposes only and the invention is not limited thereto. Specifically, this invention is not restricted to a wobble plate refrigerant compressor. Rather, this invention is applicable to the other types of refrigerant compressor, such as a scroll-type refrigerant compressor. It will be easily understood by those skilled in the art that variations and modifications can be easily made within the scope of this invention as defined by the appended claims.

I claim:

1. In a refrigerant compressor including a compressor housing defining at least one chamber in which successive strokes of sucking, compressing, and discharging a refrigerant gas is repeatedly performed, means for linking said at least one chamber to an outside chamber, and means for regulating a flow of said refrigerant gas from said chamber to the outside chamber, said linking means including a conduit communicating said at least one chamber with the outside chamber said regulating means including a plate member made of elastic material which is provided at one end opening of said conduit which opens to the outside chamber, and means for limiting the bending movement of said plate member in the direction in which said refrigerant gas leaves from said one end opening of said conduit, said plate member bending to block and open said one end opening of said conduit, said plate member having a predetermined value of elastic modulus which allows said plate member to keep blocking said one end opening of said conduit until a pressure in said at least one chamber reaches a predetermined value, the improvement comprising:

said regulating means including means for increasing the value of the elastic modulus of said plate member after said plate member bends a predetermined amount, said predetermined amount of bending being a small fraction of the total amount of bending required for said plate member to achieve a fully open position.

2. In a refrigerant compressor including a compressor housing defining at least one chamber in which successive strokes of sucking, compressing, and discharging a refrigerant gas is repeatedly performed, means for linking said at least one chamber to an outside chamber, and means for regulating a flow of said refrigerant gas from said chamber to the outside chamber, said linking means including a conduit communicating said at least one chamber with the outside, said regulating means including a plate member made of elastic material which is provided at one end opening of said conduit which opens to the outside chamber, and means for limiting the bending movement of said plate member in the direction in which said refrigerant gas leaves from said one end opening of said conduit, said plate member bending to block and open said one end opening of said conduit, said plate member having a predetermined value of elastic modulus which allows said plate member to keep blocking said one end opening of said conduit until a pressure in said at least one chamber reaches a predetermined value, the improvement comprising:

said regulating means including means for increasing the value of the elastic modulus of said plate member after said plate member bends a predetermined amount, wherein said increasing means is a curved plate member made of elastic material having a small curvature and being proximately disposed on said plate member opposite to said one end opening of said conduit.

3. The refrigerant compressor of claim 2 wherein said curved plate member is a reed valve.

4. The refrigerant compressor of claim 1 further including a cylinder head provided in the outside chamber, said cylinder head defining a discharge chamber which receives the refrigerant gas flowing from said at least one chamber through said conduit, said limiting means including a projection axially projecting from an inner surface of an axial end of said discharge chamber.

5. The refrigerant compressor of claim 4 wherein said projection includes a projection end having a slanted surface.

6. The refrigerant compressor of claim 1 wherein the limiting means includes a curved plate made of a rigid material.

7. In a refrigerant compressor including a compressor housing defining at least one chamber in which successive strokes of sucking, compressing, and discharging a refrigerant gas is repeatedly performed, means for linking said at least one chamber to an outside chamber, and means for regulating a flow of said refrigerant gas from said chamber to the outside chamber, said linking means including a conduit communicating said at least one chamber with the outside chamber, said regulating means including a plate member made of elastic material which is provided at one end opening of said conduit which opens to the outside chamber, and means for limiting the bending movement of said plate member, said plate member bending to block and open said one end opening of said conduit, said plate member having a predetermined value of elastic modulus which allows said plate member to keep blocking said one end opening of said conduit until a pressure in said at least one chamber reaches a predetermined value, the improvement comprising:

said regulating means including means for altering the value of the elastic modulus of said plate member immediately after said plate member is displaced from its initial position at which said plate member blocks said one end opening.

8. In a refrigerant compressor including a compressor housing defining at least one chamber in which successive strokes of sucking, compressing, and discharging a refrigerant gas is repeatedly performed, means for linking said at least one chamber to an outside chamber, and means for regulating a flow of said refrigerant gas from said chamber to the outside chamber, said linking means including a conduit communicating said at least one chamber with the outside chamber, said regulating means including a plate member made of elastic material which is provided at one end opening of said conduit which opens to the outside chamber, and means for limiting the bending movement of said plate member, said plate member bending to block and open said one end opening of said conduit, said plate member having a predetermined value of elastic modulus which allows said plate member to keep blocking said one end opening of said conduit until a pressure in said at least one chamber reaches a predetermined value, the improvement comprising:

said regulating means including means for altering the value of the elastic modulus of said plate member immediately after said plate member is displaced from its initial position at which said plate member blocks said one end opening, wherein said altering means is a curved plate member made of elastic material having a small curvature and being proximately disposed on said plate member opposite to said one end opening of said conduit.

* * * * *